US005673808A

United States Patent [19]

Valyi et al.

[11] Patent Number: 5,673,808

[45] Date of Patent: Oct. 7, 1997

[54] HEAT TREATED PLASTIC CLOSURE

[75] Inventors: Emery I. Valyi, Katonah, N.Y.; Gary V. Montgomery, Evansville, Ind.

[73] Assignee: EV Family Limited Partnership, New York, N.Y.

[21] Appl. No.: 384,407

[22] Filed: Feb. 6, 1995

[51] Int. Cl.[6] ..... B65D 53/00

[52] U.S. Cl. ..... 215/252

[58] Field of Search ..... 215/252

[56] References Cited

U.S. PATENT DOCUMENTS

| | | | |
|---|---|---|---|
| 2,423,582 | 7/1947 | Coleman | 215/252 |
| 4,206,851 | 6/1980 | Ostrowsky | 215/246 |
| 4,369,889 | 1/1983 | Ostrowsky | 215/246 |
| 4,394,918 | 7/1983 | Grussen | 215/243 |
| 4,907,709 | 3/1990 | Abe et al. | 215/252 |
| 4,930,647 | 6/1990 | Dutt et al. | 215/252 |
| 5,325,976 | 7/1994 | Valyi et al. . | |

*Primary Examiner*—Stephen Cronin

*Attorney, Agent, or Firm*—Bachman & LaPointe, P.C.

[57] ABSTRACT

A container closure assembly and method for providing same. The container has an access opening and a container rim surrounding the access opening. A plastic cap covers the access opening and includes an upper portion, a skirt depending from the upper portion and circumferentially covering the container rim, and a tamper ring depending from said skirt, wherein the tamper ring is preferably connected to the skirt by a plurality of tabs separated by open portions, whereby the tamper ring is disengaged from the skirt by twisting the cap and breaking the tabs. The tabs comprise a crystallized, brittle portion, whereby breaking the tabs is facilitated.

10 Claims, 2 Drawing Sheets

HEAT TREATED PLASTIC CLOSURE

BACKGROUND OF THE INVENTION

Plastic closures, for example, bottle caps, are usually made of polyolefins, preferably polypropylene. These materials are normally chosen because they are among the least expensive plastics, and they may be injection or compression molded in molds that are simpler than those that would be required for other materials. This is due to the fact that the polypropylene is sufficiently ductile to permit the caps to be stripped from the cores in the pressure molds, rather than having to be unscrewed or released by using collapsible cores.

There are, however, many disadvantages to the polypropylene caps when used for carbonated beverage bottles as well as others requiring resistance to pressure and gas permeation.

Thus, when the bottle or container is pressurized the cap or closure undergoes deformation. The extent of the deformation depends on the elastic modulus of the particular cap material, that is, its rigidity. Polypropylene, having a low elastic modulus, will deform considerably under the forces exerted by pressure in a typical carbonated beverage bottle. Thus, the pressure will cause the dome or upper portion of the closure to bulge axially upwardly and the depending skirt to bend outwardly, away from sealing engagement with the bottle neck, particularly at the upper regions of the skirt. In addition, typical bottle necks carry vent-slots that serve to depressurize the bottle when the cap is loosened at the outset of its being removed. With the bottle at low pressure, these slots are sealed off. However, with high pressure in the bottle the seal is rendered less effective than desired.

The consequence of the above is what amounts to pressure and gas leakage around the bottle or container rim and down the threaded portion of the cap. The effect of this is that there is an appreciable loss in pressure even if gas permeation through the material of the closure is largely precluded. This disadvantage of the polypropylene closure is more pronounced the better the barrier properties of the container itself. Thus, for a glass bottle, the carbonation loss in storage is due to the cap altogether. For plastic bottles, carbonation loss due to diffusion through the bottle itself is large. Thus, for example, in a 2-liter polyethylene terephthalate (PET) bottle, the diffusion loss through the bottle itself is greater than due to the cap. However, with small bottles, for example 350 ml PET bottles, the cap loss is typically near 20% of the total, and for small bottles with improved barrier properties the cap loss is up to 30 to 40% of the total.

A further deficiency of the polypropylene cap is due to the ductility of the tear band or tamper ring which is attached to the bottom of the skirt of the cap by a plurality of integral tabs. In the normal operation, the tabs are exposed to shear by twisting of the cap and should snap permitting the cap to be removed by twisting, typically counter-clockwise.

However, the drawback of polypropylene, or any other plastic of high ductility, is the excessive stretch of which the tabs are capable before the tabs break. It often happens, therefore, that the tear band remains attached to the cap, stretching in circumference, to come off with the remainder of the cap. When that happens, the entire cap can be replaced with little visible trace of what has occurred, thus obviating the purpose of tamper evidence. More often, the difficulty in severing the tabs when trying to open the bottle is a nuisance, if not a hinderance, for children and the elderly.

It is, therefore, the principal object of the present invention to provide a container cap assembly including a tamper ring wherein the tamper ring is easily and conveniently removed in a reliable manner upon rotating the cap.

It is a still further object of the present invention to provide a container cap assembly as aforesaid which minimizes loss of carbonation due to the cap.

It is a still further object of the present invention to provide an improved cap and method for obtaining same.

Further objects of the present invention will appear hereinbelow.

SUMMARY OF THE INVENTION

In accordance with the present invention the foregoing objects and advantages may be readily obtained.

The container cap assembly of the present invention comprises: a container having an access opening for the container, a container rim surrounding the access opening, and a container neck depending from the container rim; a plastic cap covering the access opening and having an upper portion, a skirt depending from the upper portion and circumferentially covering the container neck, and a tamper ring depending from said leg and connected to the leg, wherein the tamper ring is disengaged from the leg preferably by twisting the cap; and wherein said tamper ring includes a brittle portion therein, whereby disengaging the tamper ring is facilitated. The cap is made of crystallizable polymer and the brittle portion is crystallized. Preferably, the tamper ring is connected to the leg by a plurality of tabs separated by open portions, with the tabs comprising a portion rendered brittle by crystallizing, wherein the tabs are preferably broken by twisting the cap.

The preferred material of the plastic cap is polyethylene terephthalate (PET). Also, preferably the brittle portion has a level of crystallinity in excess of 30%.

In the preferred embodiment, the container rim and cap skirt include threads, whereby the cap is removed and the tamper ring disengaged by screwing off the cap. Also, it is preferred to heat treat at least the skirt of the cap in order to shrink the cap on the container rim and thereby provide a firmer engagement between the cap and container rim.

The present invention also resides in an improved cap for closing a container.

The present invention also provides a method for providing a container cap assembly. The method comprises providing a container having an access opening, a container rim surrounding the access opening and a container neck depending from the container rim. In accordance with the method of the present invention, the access opening is covered with a plastic cap having an upper portion, a skirt depending from the upper portion and circumferentially covering the container neck, and a tamper ring depending from said skirt, wherein the tamper ring is connected to the skirt and disengaged from the skirt preferably by twisting the cap; and heat treating at least one of the tamper ring and skirt. Preferably, the cap is made of crystallizable polymer and the tamper ring is heat treated to form a crystallized, brittle portion therein, whereby disengaging the tamper ring is facilitated.

Further features of and advantages of the present invention will appear hereinbelow.

BRIEF DESCRIPTION OF THE DRAWINGS

The present invention will be more readily understood from a consideration of the following illustrative embodiments wherein.

DETAILED DESCRIPTION OF THE PREFERRED EMBODIMENTS

Figure 1:
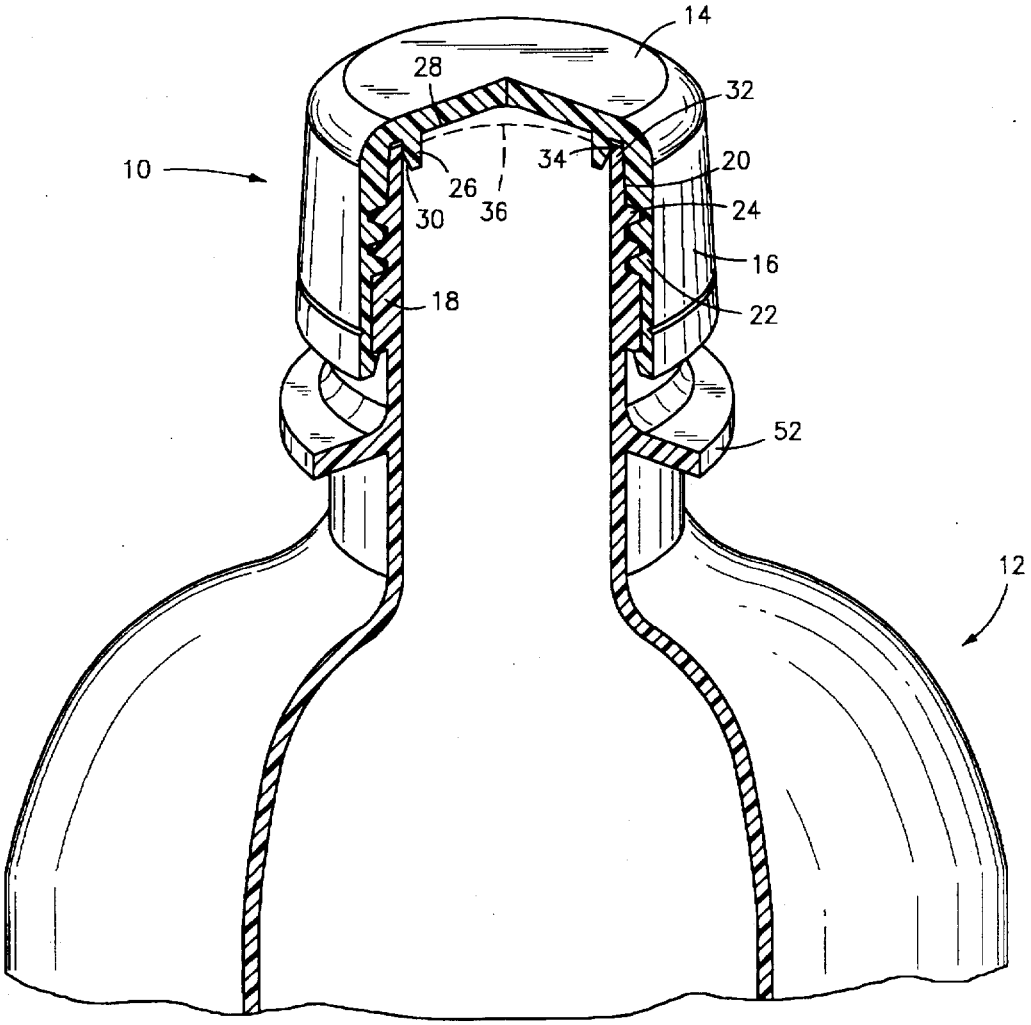
FIG–1 (PRIOR ART)
FIG. 1 is a perspective view of a prior art container closure assembly.

A typical prior art bottle cap 10 is shown in FIG. 1 applied to container 12. Cap 10 consists of dome or upper portion 14 and skirt 16 depending from dome 14 and circumferentially covering container neck 18. The inside face 20 of skirt 16 preferably carries thread 22 conforming to thread 24 on container neck 18. In the embodiment shown in FIG. 1, cap lip 26 protrudes downwardly from inside wall 28 of dome 14 including a tapered sealing surface 30 corresponding to container rim 32 tapered surface 34 intended to contain the pressure and gas in container 12. Other systems may be used instead of the matching tapers, as for example substantially flat inside dome wall 28 accommodating a barrier liner 36 shown in dashed lines which is compressible enough to provide a seal against container rim 32.

However, when container 12 is pressurized with for example a carbonated beverage, cap 10 undergoes deformation. Thus, the typical carbonated beverage will cause a polypropylene dome 14 to bulge axially upwardly and skirt 16 to bend outwardly, both away from sealing engagement with container neck 18 and container rim 32, particularly at the upper regions of the skirt. This results in the disadvantageous pressure and gas leakage around the container rim and down the threaded portion of the cap to the effect that appreciable loss in pressure results even if the material of the cap essentially precludes gas permeation therethrough.

Figure 2:
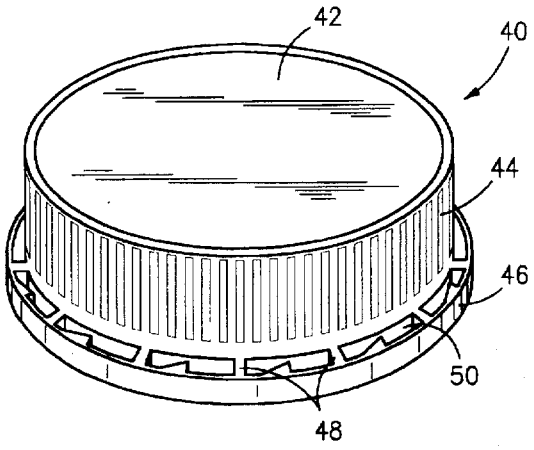
FIG. 2 is a perspective view of a cap of the present invention.

FIG. 2 shows an embodiment of the present invention comprising cap 40 having dome or upper portion 42, skirt 44 depending from the dome and tamper ring 46 connected to skirt 44 by a plurality of tabs 48 separated by open portions 50. Typically tamper ring or tear band 46 is forced into place against container support ring 52 (as shown for example in the embodiment of FIG. 3) that may carry a series of ratchet teeth to prevent rotation of the tear band with the rest of the cap when the cap is twisted in a direction opposite to the direction the cap is turned on closing. Thus, upon opening the container tabs 48 are exposed to shear and should snap permitting the cap 40 to be removed and leaving tamper ring 46 on the container as evidence that the container has been opened.

In accordance with the present invention, the cap is made of a crystallizable polymer, preferably PET, and the tamper ring is heat treated to form a crystallized, brittle portion therein whereby disengaging the tamper ring is facilitated.

Polypropylene, or any other plastic of high ductility, results in excessive stretch of tabs 48 before breaking the tabs upon twisting of the cap. It often happens, therefore, that the tear band 46 in prior practice remains attached to skirt 44, stretching in circumference, to be removed from the container when the rest of the cap is removed. Obviously, when that occurs, the entire cap can be replaced with little visible trace that the cap has been removed and thus obviating the purpose of the tamper ring. Certainly, also by rendering separation of the tamper ring more difficult a considerable inconvenience results.

Figure 4:
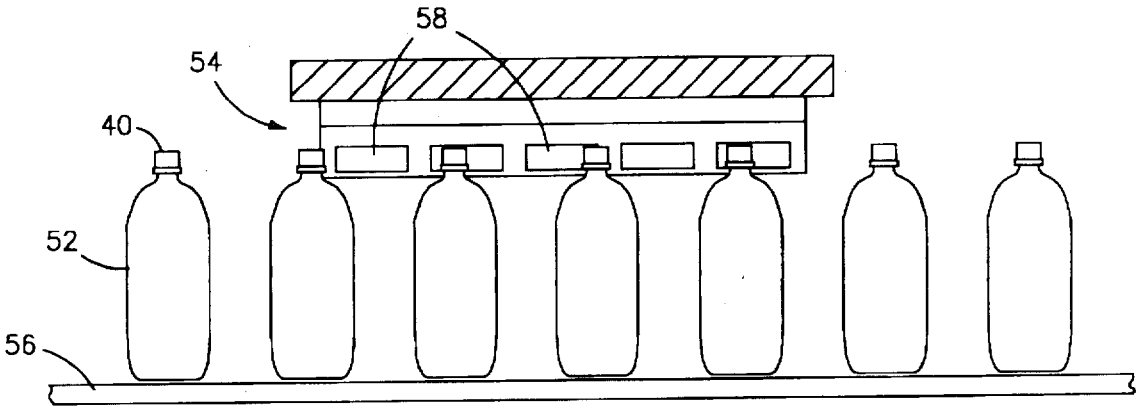
FIG. 4 is a schematic view showing heat treatment of the cap applied to the container.

The present invention overcomes the foregoing disadvantages by heat treating the tamper ring, and generally the entire cap, with the heat treatment taking place after application of the cap to the container and after the filling operation. Thus, as shown in FIG. 4, container 52 with cap 40 applied thereto after the filling operation is transferred to heating tunnel 54 on moving transfer belt 56 wherein heating units 58 heat the tabs 48 of cap 40 on container 52. The heaters are preferably infra-red heaters that are directed towards the cap, preferably focussed upon the tabs, with sufficient time being provided in tunnel 54 to crystallize tabs 48 and to provide a crystallized, brittle portion therein. Generally, the brittle portion has a level of crystallinity in excess of 30%.

The plastic material used for the cap should preferably exhibit a relatively high elastic modulus and low ductility. A preferred material is polyethylene terephthalate or like materials which are rigid and capable of a considerable change of volume due to change in morphology, e.g., crystalline polymers, and capable of being made brittle by thermal or mechanical treatment.

The cap of the present invention is preferably pressure molded, i.e., injection or compression molded, or thermoformed. In any case, the closure, as prepared or molded will be largely amorphous, but also it will carry an amount of residual stress due to having been cooled under constraint in a mold after having been forced thereinto at high temperature.

In one embodiment of the present invention, tear band 46 is crystallized, as by heating as shown in FIG. 4 for between 150° C. and 200° C. for 3 to 30 seconds. Due to such heating, the tear band will become sufficiently brittle to readily shear tabs 48 due to but little torque against the cap. Alternatively, the crystallization may be effected by heating the cap in the mold before application to the container, although the preferred embodiment is to heat after application to the container as shown in FIG. 4 because application of the cap to the container is easier while they are at low crystallinity and are therefore reasonably ductile.

In another embodiment of the present invention, the cap is applied to the container in the as molded state and the entire cap including the skirt and tamper ring is heated as shown in FIG. 4 after application to the container, the tamper ring being heated to crystallize and the skirt being heated to shrink. The heat treatment to shrink is preferably at 85° C. to 150° C. for 3 to 30 seconds. The embodiment to heat the cap to shrink same is particularly useful even in the absence of a tamper ring. In accordance with this embodiment, the skirt will shrink more firmly onto the container neck than by torque because the density of crystallized PET is greater than in the mostly amorphous state. A similar effect may be obtained due to stress relief, by heating below a favorable crystallizing temperature. Depending on molding conditions, the resulting part may be more or less stressed. A molded part carrying high residual stress shrinks appreciably when heated to a temperature inducive of stress relief. Thus, in accordance with this embodiment, the entire cap is heat treated after application to the bottle.

Figure 3:
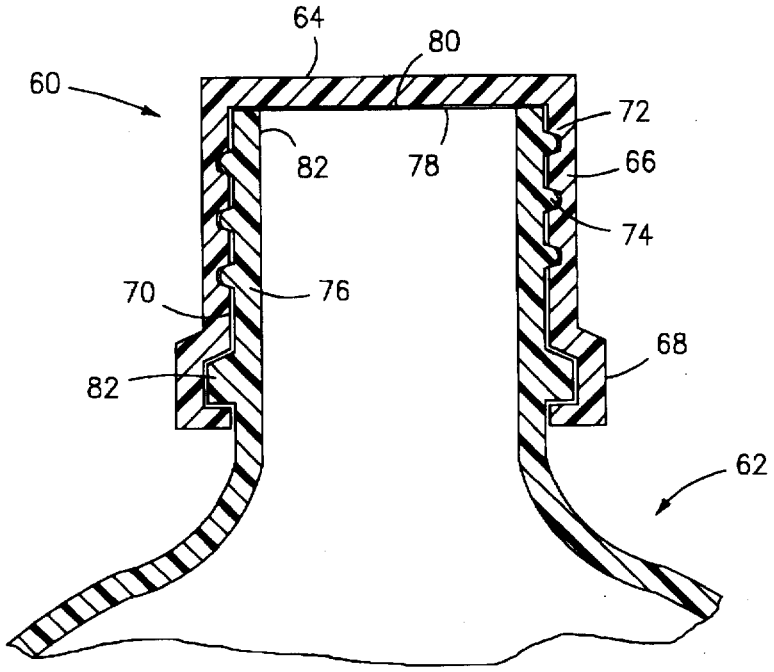
FIG. 3 is a sectional view of a cap of the present invention applied to a container to form a container closure assembly.

An embodiment of the resultant product is shown in FIG. 3 wherein cap 60 is applied to container 62. Cap 60 includes dome or upper portion 64, skirt 66 depending from the dome and tamper ring 68 connected to skirt 66. The inside face 70 of skirt 66 carries thread 72 conforming to thread 74 on container neck 76. In this embodiment, cap 60 includes barrier liner 78 on inside surface 80 of dome 64 sealing container rim 82. Tampering ring 68 is adjacent container support ring 82. In accordance with the present invention, cap 60 is heated as aforesaid after application to container 62, resulting in shrinkage of skirt 66 into tight engagement with container neck 76. Also, heated tamper ring 68 is crystallized to form a brittle portion therein, whereby disengaging the tamper ring from the skirt is facilitated, as for example, by breaking tabs connecting the tamper ring to the skirt.

In accordance with a still further embodiment of the present invention, a cap without internal threads may be placed on the container neck as shown in FIG. 3. The cap is then heated for stress relief and/or crystallizing as before, thereby becoming sufficiently hot to be formable. Thus, threads may be formed in place against the container neck threads to a sufficient depth to transmit the torque needed for unscrewing the cap. Tightness will have been provided by the shrinkage overall. If desired, pressure may be placed on the cap after heating to facilitate formation of the threads thereon.

It is to be understood that the invention is not limited to the illustrations described and shown herein, which are deemed to be merely illustrative of the best modes of carrying out the invention, and which are susceptible of modifications of form, size, arrangement of parts and details of operation. The invention rather is intended to encompass all such modifications which are within its spirit and scope as defined by the claims.

What is claimed is:

1. A container cap assembly, which comprises: a container having an access opening for the container, a container rim surrounding the access opening, and a container neck depending from the container rim; a plastic cap covering the access opening and having an upper portion, a skirt depending from the upper portion and circumferentially covering the container neck, and a tamper ring depending from the skirt and connected thereto, wherein the tamper ring is disengaged from the skirt, wherein said tamper ring includes a brittle portion therein to facilitate disengaging the tamper ring and wherein said cap is made of crystallizable polymer and the brittle portion is crystallized, wherein the tamper ring is connected to the skirt by a plurality of tabs separated by open portions, wherein removing the cap from the container breaks the tabs and wherein said tabs comprise a crystallized, brittle portion whereby breaking the tabs is facilitated.

2. An assembly according to claim 1, wherein the cap is polyethylene terephthalate.

3. An assembly according to claim 1, wherein the brittle portion has a level of crystallinity in excess of 30%.

4. An assembly according to claim 1, wherein the container neck and cap skirt include threads, whereby the cap is removed and tamper ring disengaged by screwing off the cap.

5. An assembly according to claim 1, wherein the cap is heat treated to shrink the cap on the container and thereby provide a firm engagement between the cap and container.

6. A cap for closing a container, which comprises: a plastic cap for covering the opening of a container and having an upper portion, a skirt depending from the upper portion, and a tamper ring depending from the skirt and connected thereto, wherein the tamper ring is disengaged from the skirt, wherein said tamper ring includes a brittle portion therein to facilitate disengaging the tamper ring, and wherein the cap is made of crystallizable polymer and the brittle portion is crystallized, wherein the tamper ring is connected to the skirt by a plurality of tabs separated by open portions, wherein removing the cap from the container breaks the tabs and wherein said tabs comprise a crystallized, brittle portion whereby breaking the tabs is facilitated.

7. A cap according to claim 6, wherein the cap is polyethylene terephthalate.

8. A cap according to claim 6, wherein the brittle portion has a level of crystallinity in excess of 30%.

9. A cap according to claim 6, wherein the cap skirt includes threads.

10. A cap according to claim 6, wherein the cap is heat treated to shrink the cap.

* * * * *